US010149061B2

(12) United States Patent
Liu et al.

(10) Patent No.: US 10,149,061 B2
(45) Date of Patent: Dec. 4, 2018

(54) SPEAKER AND SPEAKER-BOX

(71) Applicants: Lin Liu, Shenzhen (CN); Jinming Li, Shenzhen (CN)

(72) Inventors: Lin Liu, Shenzhen (CN); Jinming Li, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/415,924

(22) Filed: Jan. 26, 2017

(65) Prior Publication Data

US 2018/0167738 A1 Jun. 14, 2018

(30) Foreign Application Priority Data

Dec. 12, 2016 (CN) ..... 2016 2 1360276 U

(51) Int. Cl.
*H04R 1/02* (2006.01)
*H04R 9/06* (2006.01)
*H04R 31/00* (2006.01)

(52) U.S. Cl.
CPC ..... *H04R 9/06* (2013.01); *H04R 1/025* (2013.01); *H04R 31/006* (2013.01); *H04R 1/023* (2013.01)

(58) Field of Classification Search
CPC .. H04R 1/023; H04R 1/2807; H04R 2499/11; H04R 9/025; H04R 1/2803; H04R 1/021; H04R 7/20; H04R 9/06; H04R 1/025; H04R 31/006
USPC ..... 381/397, 345, 395, 400–420, 337–339, 381/396
See application file for complete search history.

(56) References Cited

U.S. PATENT DOCUMENTS 6,259,800 B1 * 7/2001 Tagami ..... H04R 9/025 381/398
2004/0101149 A1 * 5/2004 Furuyama ..... H04R 7/20 381/152
2012/0160597 A1 * 6/2012 Li ..... H04R 7/04 181/157
2012/0170793 A1 * 7/2012 Jiang ..... H04R 9/025 381/412
2014/0023224 A1 * 1/2014 Tao ..... H04R 1/02 381/412
2014/0056447 A1 * 2/2014 Li ..... H04R 1/00 381/162
2014/0133684 A1 * 5/2014 Zha ..... H04R 1/021 381/345
2015/0016659 A1 * 1/2015 Wang ..... H04R 9/06 381/412

(Continued)

*Primary Examiner* — Curtis A Kuntz
*Assistant Examiner* — Julie X Dang
(74) *Attorney, Agent, or Firm* — Na Xu; IPro, PLLC

(57) ABSTRACT

A speaker and a speaker-box using the same is provided in the present disclosure. The speaker includes a basket and a vibration system. The vibration system includes a diaphragm fixedly connected to the basket. The diaphragm includes a body part and a fixed part bent and extended from the edge of the body part to the basket, the basket includes a side wall encircling the receiving space, the side wall includes an upper surface opposite to the body part and an outer side surface extended from the outer edge of the upper surface, and the upper surface encircles an opening communicated with the receiving space; the body part covers the opening and is fixed with the upper surface, and the fixed part is extended along the outer side surface and fixed with the outer side surface.

3 Claims, 4 Drawing Sheets

(56) References Cited

U.S. PATENT DOCUMENTS

| | | | | |
|---|---|---|---|---|
| 2015/0319535 | A1* | 11/2015 | Xu | H04R 7/18<br>381/412 |
| 2016/0088398 | A1* | 3/2016 | Kim | H04R 7/18<br>381/395 |
| 2016/0316298 | A1* | 10/2016 | Ohura | H04R 7/18 |

* cited by examiner

SPEAKER AND SPEAKER-BOX

FIELD OF THE DISCLOSURE

The present invention relates to the field of electro-acoustic transduction, and more particularly, to a speaker and a speaker-box using the same.

BACKGROUND

With development of mobile communication technologies, portable electronic devices, such as mobile phones, handheld game players, portable multimedia players, or the like, become more and more popular. Portable electronic devices generally include speaker for generating sound.

In a relevant technology, the sound production unit is often fixed inside a side sounding speaker-box in three directions, and has the risks of diaphragm warping and basket separation caused by multiple tests of water and gas leak inspection, drop, transportation and the like, thereby increasing the defect rate of gas leak inspection of products, further influencing waterproof failure of the speaker and seriously influencing the quality of the speaker. In the solution of improving the waterproof performance of the speaker, the speaker is generally fixed in four directions, and this solution may reduce the height of a front cavity channel, so that the acoustic performance of the speaker is reduced.

Therefore, it is desired to provide a speaker and a speaker-box using the same to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
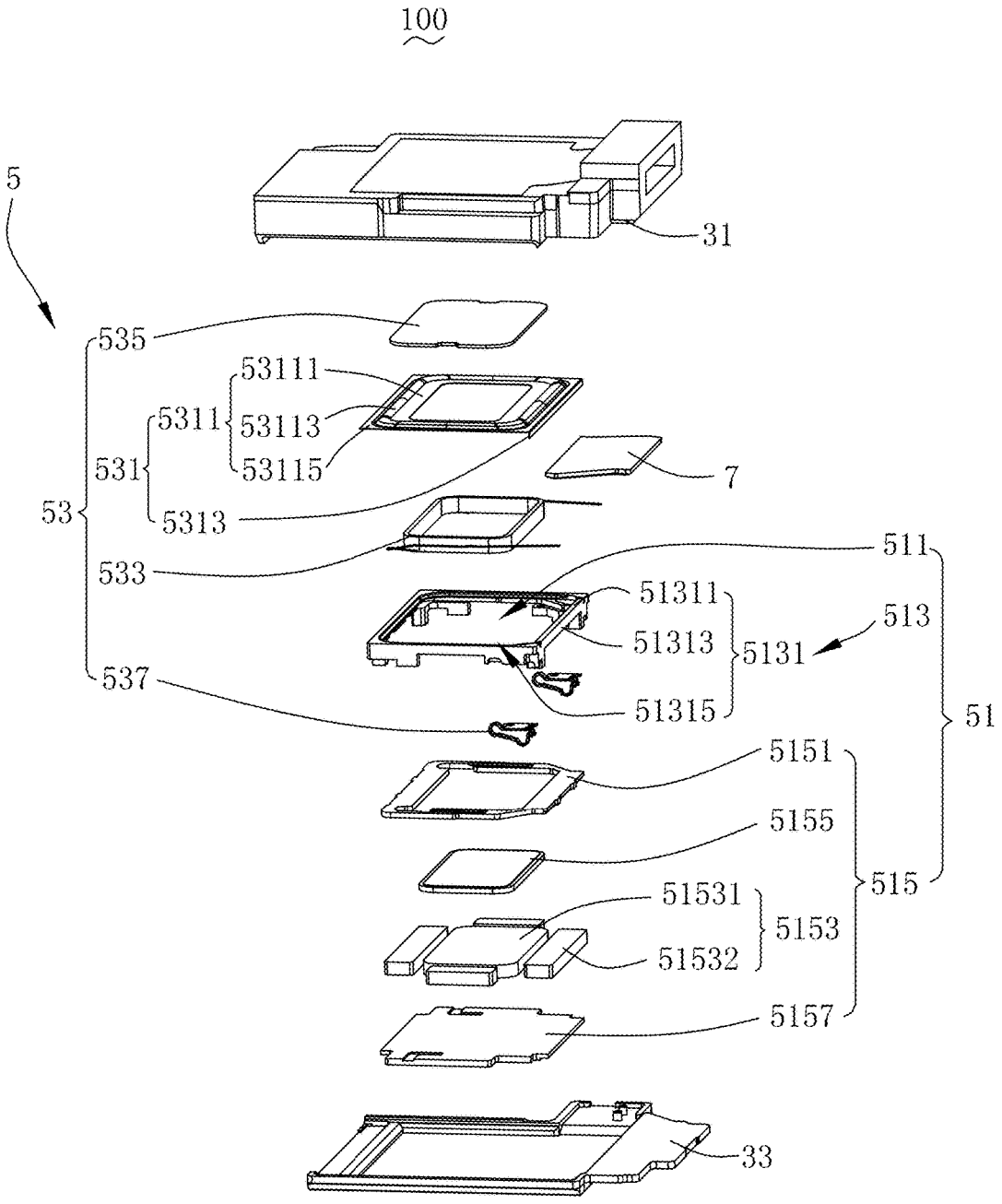
FIG. 1 is an exploded schematic diagram of a speaker-box of the present invention.
Figure 2:
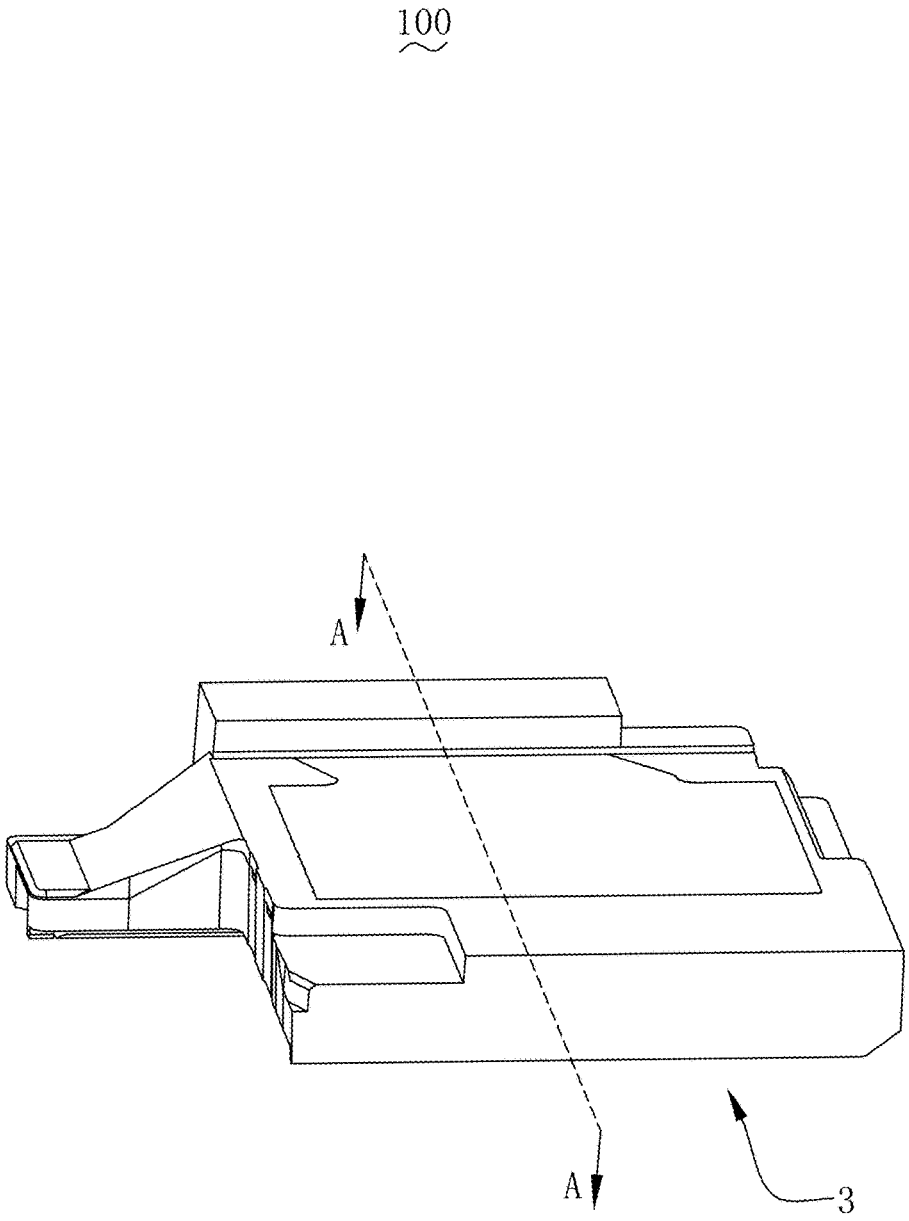
FIG. 2 is a three-dimensional structural schematic diagram of the speaker-box shown in FIG. 1.
Figure 3:
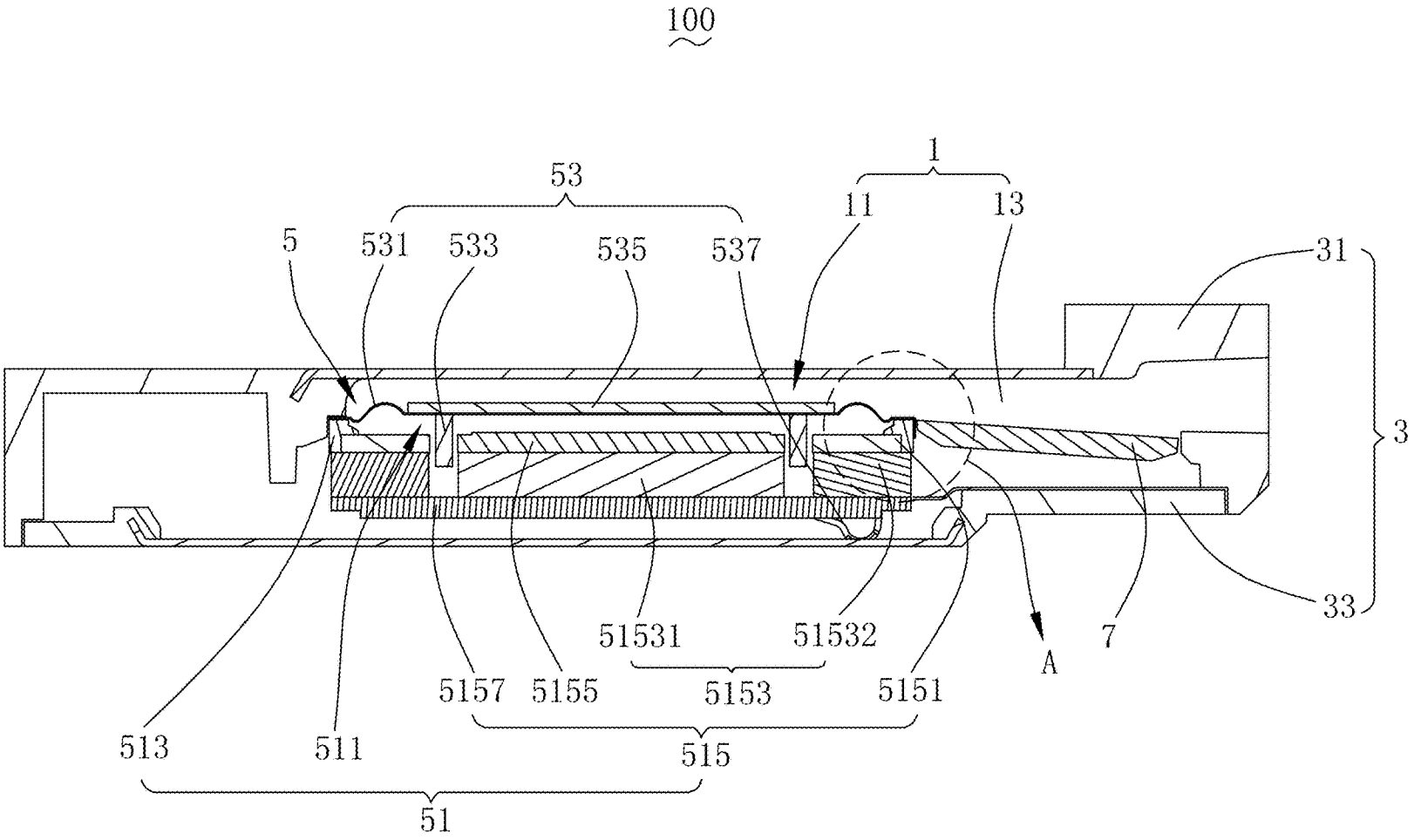
FIG. 3 is a cross-sectional structural schematic diagram of the speaker-box shown in FIG. 2 along an A-A line.
Figure 4:
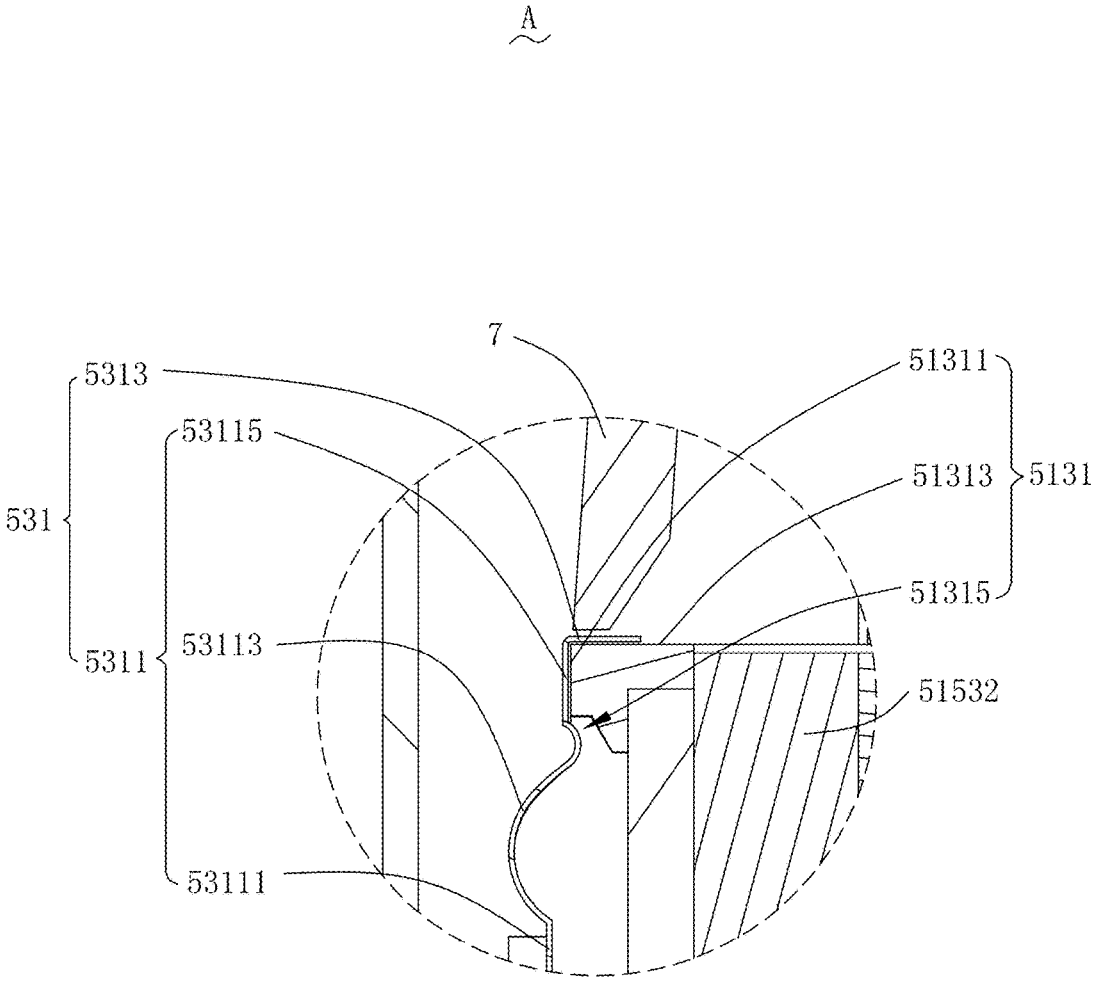
FIG. 4 is an enlarged view of part A shown in FIG. 3.

As shown in FIGS. 1-4, a speaker-box 100 includes a shell 3 with an accommodating space 1, a speaker 5 received in the accommodating space 1 and a baffle plate 7 fixed in the shell 3.

The shell 3 includes an upper cover 31 and a lower cover 33 covered by the upper cover 31 to form the accommodating space 1.

The accommodating space 1 includes a front sound cavity 11 formed by the upper cover 31 and the speaker 5 and a sound outlet channel 13 formed by the upper cover 31 and the baffle plate 7 and communicated with the front sound cavity 11.

The speaker 5 includes a fixed system 51 and a vibration system 53, the fixed system 51 includes a basket 513 with a receiving space 511 and a magnetic circuit system 515 received in the receiving space 511, and the vibration system 53 is received in the receiving space 511 and driven by the magnetic circuit system 515 to vibrate and produce sound.

The basket 513 includes a side wall 5131 encircling the receiving space 511.

The side wall 5131 includes an upper surface 51311, an outer side surface 51313 extended from the outer edge of the upper surface 51311 and an opening 51315 encircled by the upper surface 51311 and communicated with the receiving space 511. The outer side surface 51313 is a side surface of the side wall 5131 away from the receiving space 511.

The magnetic circuit system 515 includes an upper clamping plate 5151 fixedly disposed on the basket 513, a magnet 5153 received in the basket 513, a pole plate 5155 overlapped to one side of the magnet 5153 close to the upper cover 31 and a yoke 5157 overlapped to the other side of the magnet 5153.

The magnet 5153 includes a main magnet 51531 and secondary magnets 51532 symmetrically disposed on two sides of the main magnet 51531. A magnetic gap is formed between the main magnet 51531 and the two secondary magnets 51532.

The upper clamping plate 5151 is overlapped on the secondary magnets 51532 and fixedly held on the basket 513.

The pole plate 5155 is overlapped on the main magnet 51531 and located in a through hole of the upper clamping plate 5151 and within the same horizontal plane as the upper clamping plate 5151.

The vibration system 53 includes a diaphragm 531 fixed on the upper surface 51311 of the basket 513, a voice coil 533 having one end inserted into the magnetic gap formed by the main magnet 51531 and the secondary magnets 51532 and the other end fixed on one side of the diaphragm 531, a reinforcing plate 535 fixed on the other side of the diaphragm 531 away from the voice coil 533 and a conductive terminal 537 fixed on the basket 513.

The diaphragm 531 includes a body part 5311 and a fixed part 5313 bent and extended from the edge of the body part 5311 to the outer side surface 51313. The fixed part 5313 is formed by bending and extending one side edge close to the baffle plate 7, one side of the fixed part 5313 is bonded and fixed with the outer side surface 51313, and the other side of the fixed part 5313 is bonded and fixed with the baffle plate 7.

The body part 5311 includes a dome 53111, a meander part 53113 bent and extended from the edge of the dome 53111 and a joint part 53115 surrounding the meander part 53113 and bonded and fixed with the upper surface 51311.

Specifically, the fixed part 5313 can also be bent and extended from at least one of three side edges of the joint part 53115 away from the baffle plate 7, and bonded and fixed to the outer side surface 51313; that is, the fixed part 5313 can be simultaneously bent and extended from four side edges of the joint part 53115, so that the diaphragm 531 is fixed on the basket 513 more firmly.

Upon the joint part 53115 is bonded and fixed on the upper surface 51311, the fixed part 5313 is bonded and fixed to the outer side surface 51313, so that the diaphragm 531 is fixed on the basket 513 more firmly in order to solve the risks of warping of the diaphragm 531 and separation from the basket 513 due to multiple tests of water and gas leak inspection, drop, transportation and the like; the test performance does not need to be improved by fixing the speaker 5 in four directions in the prior art while the acoustic performance of the speaker-box 100 is influenced; and the waterproof performance of the speaker-box 100 is improved without changing the acoustic performance thereof.

Compared with the prior art, the speaker and the speaker-box using the same provided by the present invention have the advantages that the joint part and the fixed part of the diaphragm are respectively bonded and fixed on the upper surface and the outer side surface of the basket, so that the diaphragm is bonded on the basket more firmly, the risks of diaphragm warping and basket separation caused by multiple tests of water and gas leak inspection, drop, transportation and the like are solved, the waterproof performance of the speaker-box is improved without changing the acoustic performance thereof, and the product quality of the speaker-box is improved on the whole.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker-box, comprising a shell with an accommodating space and a speaker received in the accommodating space, the speaker comprising:

a basket with a receiving space; and a vibration system, comprising a diaphragm fixedly connected to the basket and a voice coil for causing the diaphragm to vibrate and produce sound, wherein the diaphragm comprises a body part and a fixed part, the body part comprises a dome, a meander part bent and extended from the edge of the dome, and a joint part extended from the edge of the meander part, the fixed part is bent and extended from the edge of the joint part;

the basket comprises a side wall encircling the receiving space, the side wall comprises an upper surface opposite to the body part and an outer side surface extended from the outer edge of the upper surface, and the upper surface encircles an opening communicated with the receiving space;

the body part covers the opening and the joint part thereof is fixed with the upper surface, and the fixed part is extended along the outer side surface and fixed with the outer side surface;

a front sound cavity is formed between the shell and the diaphragm, a baffle plate is fixed in the shell, the baffle plate and the shell form a sound outlet channel communicated with the front sound cavity, the baffle plate abuts the fixed part and is bonded and fixed with the fixed part.

2. The speaker-box as described in claim 1, wherein the vibration system further comprises a reinforcing plate overlapped to one side of the dome away from the receiving space.

3. The speaker-box as described in claim 1, wherein the speaker further comprises a magnetic circuit system received in the receiving space, the magnetic circuit system comprises a magnet set, the magnet set comprises a main magnet and secondary magnets symmetrically disposed on two sides of the main magnet, a magnetic gap is formed between the main magnet and the secondary magnets, one end of the voice coil is fixed with the dome, and the other end of the voice coil is inserted into the magnetic gap.

* * * * *